340-552 SR
5/15/79 XR 4,155,078

United States Patent [19] [11] 4,155,078
Bowling et al. [45] May 15, 1979

[54] SINGLE WIRE INTRUSION DETECTOR SYSTEM

[75] Inventors: Roy E. Bowling, Denver; Gary B. Shaffstall, Arvada, both of Colo.

[73] Assignee: John E. Reilly, Denver, Colo.

[21] Appl. No.: 741,332

[22] Filed: Nov. 12, 1976

[51] Int. Cl.[2] ..... G08B 13/24
[52] U.S. Cl. ..... 340/561; 340/552
[58] Field of Search ..... 340/258 A, 258 B, 258 C, 340/258 D, 261, 258 R, 552, 553, 561, 565, 567; 325/435

[56] References Cited

U.S. PATENT DOCUMENTS

| | | | |
|---|---|---|---|
| 3,163,861 | 12/1964 | Suter | 343/14 |
| 3,237,105 | 2/1966 | Kalmus | 325/29 |
| 3,378,834 | 4/1968 | Corbell | 343/5 |
| 3,549,892 | 12/1970 | Perlman | 250/214 |
| 3,665,445 | 5/1972 | Riley, Jr. | 340/261 |
| 3,673,589 | 6/1972 | Barrett et al. | 340/258 D |
| 3,727,207 | 4/1973 | Missio et al. | 340/258 B |
| 3,771,152 | 11/1973 | Dettling et al. | 340/258 C |
| 3,793,617 | 2/1974 | Jolman | 340/1 R |
| 3,833,897 | 9/1974 | Bell et al. | 340/261 |
| 3,956,743 | 5/1976 | Geiszler et al. | 340/258 C |
| 3,961,321 | 6/1976 | Moss | 340/258 B |

*Primary Examiner*—John W. Caldwell, Sr.
*Assistant Examiner*—Joseph E. Nowicki
*Attorney, Agent, or Firm*—John E. Reilly

[57] ABSTRACT

A single wire antenna placed in proximity to an area to be protected senses the presence of electromagnetic fields including the normal ambient field and modulation thereof resulting from the presence of a moving intruder. The antenna signals are demodulated and filtered to provide the input to circuitry for inspecting these signals and producing a signal based upon differentiation between normal transient signals and random modulation signals associated with the movement of an intruder. Digital counter circuitry provides the differentiation and various time-out features can be incorporated to control the generation and/or transmission of alarm signals. The system includes various elements to permit easy testing of system operations by the user.

19 Claims, 8 Drawing Figures

SINGLE WIRE INTRUSION DETECTOR SYSTEM

BACKGROUND OF THE INVENTION

The present invention is concerned with methods and apparatus for detecting the presence of an intruder within a preselected area. More particularly, the present invention relates to methods and apparatus for sensing the presence of ambient field modulation by movement of an intruder through antenna detection of the wave patterns present within an area to be protected. The present invention is particularly useful in conjunction with security monitoring of rooms, buildings, or the like and is equally applicable to utilization within residences, business establishments, open areas having substantial utility power line originated ambient electromagnetic fields present and the like.

It has been known for some time that movement of a person within an area wherein there is ambient electromagnetic signals produces a low frequency modulation of those signals in the range of from 0 to 20 hz. For instance, U.S. Pat. No. 3,163,861 by Suter uses the reflected radio frequency signals from a commercial frequency-modulation transmitter to detect intruder presence in a protected area. A broad band AM detector monitors the FM envelope and sets off an alarm if this envelope varies from a balanced condition. Suter selects commercial FM stations transmissions for this purpose since the wave length is roughly proportional to the size of the average person and thus most likely to provide stronger reflective modulation signals. A similar approach is employed by U.S. Pat. Nos. 3,237,105 by Kalmus and 3,378,834 by Corbell except that discrete, controlled transmitters are employed rather than a commercial FM transmission. Kalmus and Corbell employ carefully located transmitter and receiving antennas so as to detect movement therebetween by the intended intrusion detector. All such prior art devices are severely limited in that careful location of the transmitter and receiving antennas must be maintained and further are generally incapable of significantly differentiating over transient signals not caused by an intruder. Thus, signals such as telephone ringing, pulses, refrigerator motor actuations and the like are sensed by such systems and produce alarm signals falsely indicating the presence of an intruder. Similar limitations are present for U.S. Pat. No. 3,833,897 by Bell et al which uses integrator circuits in an effort to distinguish signals originating from disturbances of an "electret" cable on a fence or the like.

Other prior art devices have used light sensitive circuits to detect intervention by an intruder such as U.S. Pat. No. 3,549,892 by Perlman and U.S. Pat. No. 3,727,207 by Missio et al. Perlman cyclically gates the output of a light sensitive receiver so that an integrator must receive a sufficiently strong input to rapidly accumulate an output beyond a preselected threshold level during a time period established by a monostable multivibrator before a alarm is generated. Missio et al uses logic circuitry to detect that reflected pulses occur out of tolerance as established by flip-flop circuits.

Yet other intrusion detector systems are contingent upon capacitive variation sensing or static charge detection. Unfortunately, such systems are sensitive to uncontrollable variables such as humidity variations and the like which render them of little value in many practical applications.

Accordingly, there has been a continuing need for an intrusion detector system which can operate reliably in ambient conditions without requiring special tailoring of transmitter and receiver antennas along with the attendant requirements for proper location thereof. Further, there has been a continuing need for an intrusion detector system which can be easily adapted to the areas requiring surveillance while allowing manufacture with minimal cost so as to allow utilization in a large variety of environments. Ideally, such a system should be easily installable and require minimal attention and adjustment after installation despite varying conditions within the environment. The system should allow the user to select sensitivity so as to differentiate between different objects within the protected area.

SUMMARY OF THE INVENTION

The present invention is a method and system for allowing detection of the presence of a moving intruder within an area to be kept under surveillance. The system requires no special transmitting antennas and has flexible sensitivity to allow control by the user. Furthermore, the system differentiates between transient and intruder originating electromagnetic signals so as to produce reliable alarm indication signals regardless of variations of the ambient environment being monitored. The present invention is particularly well-suited for easy installation and reliable operation within the environment of residences and the like and is furthermore easily adaptable for use in conjunction with monitoring operations of police departments, security agencies or the like.

Apparatus in accordance with the present invention is capable of reliably sensing the presence of a range of modulation signals imposed upon the ambient electromagnetic waves within an area requiring surveillance wherein the modulation signals results from movement of an intruder within the area. An antenna is placed for detecting the presence of the electromagnetic waves including modulation thereof within the surveillance area and the output of this antenna is coupled to a demodulation circuit. The demodulated output is passed through a filter so that the output of this filter includes only demodulated signals within the range originated from the intruder movement within the area. The demodulated and filtered signals are differentiated to produce an output reflecting the presence of signals originating from random modulation of the ambient electromagnetic waves as is caused by the movement of an intruder within the area. This differentiated signal is then employed for establishing an alarm of one sort or another.

As will be described in greater detail in conjunction with the exemplary preferred embodiment, the demodulator can take the form of an integrator circuit whereas the filtering can be effected in the known moving person modulation range of 0 to 20 hertz or cycles per second. The pulses requiring differentiation can be employed to actuate appropriate control pulse generators to increment a counter so that this counter is loaded to a preselected content which can only occur in the presence of the randomly varying frequencies associated with the movement of an intruder within the electromagnetic waves of the surveillance area. Typically the counter is regularly reset and is enabled for a predefined window or gate time by the pulse generator circuitry.

Additional features of the present invention will be more fully apparent from the detailed description including adaptations of the invention for allowing an authorized intruder sufficient time to disable the alarm generation, arrangement for allowing the user to confirm proper operation of the system without generating a false alarm, adjustability of the signal levels handled so as to accommodate selection of the distance to be monitored by the equipment, power backup and power loss alarm indicating adaptations and so forth.

Various other features, objects and advantages of the present invention will be more readily apparent in light of the following detailed description of an exemplary preferred embodiment taken together with the accompanying drawings:

DETAILED DESCRIPTION OF THE PREFERRED EMBODIMENT

Figure 1:
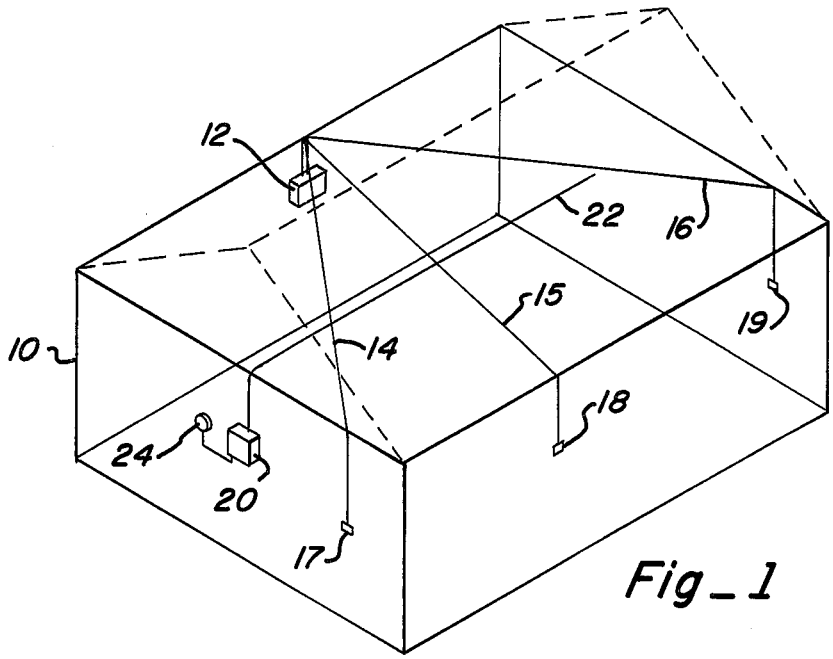
FIG. 1 is a perspective and partially phantom view of an installation of the present invention within a room.

FIG. 1 presents a somewhat phantom but perspective view of a building 10 to be kept under surveillance by the present invention. On the rear wall of building 10 is a typical conventional circuit breaker box 12 from which the various power distribution lines 14, 15 and 16 are shown in somewhat random array for connection to wall outlets 17, 18 and 19. On yet another wall, preferably internal to the enclosure of building 10, is a housing 20 containing the present invention with the single wire antenna 22 being shown arranged in extension across the upper level or attic area of building 10. Also connected to an output line from housing 20 is an alarm bell 24. Although the present invention will be described in conjunction with an alarm bell, various other alarm systems can be included separately or in conjunction with such a bell, such as, the telecommunications with remote locations or the like. Further, alarm bell 24 can obviously be incorporated within housing 20 if desired.

Figure 2:
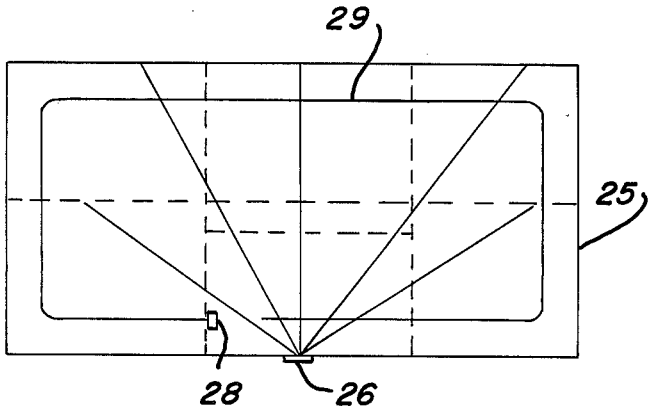
FIG. 2 is a top plan view of a dwelling illustrating an arrangement for perimeter surveillance.

The single wire antenna 22 arrayed as shown in FIG. 1 has been found to be effective for intrusion detection within rooms of typical residential size. In the event that it is desirable to protect the entire area of a residence, the single wire antenna could be extended throughout the central portion of the building and the sensitivity adjusted appropriately to detect the presence of intruders anywhere within that building. Alternatively, FIG. 2 shows a top plan view of a dwelling 25 having several room partitions contained therein and likewise having a conventional circuit breaker box 26 from which a plurality of somewhat randomly arrayed power lines are connected to appropriate points within the building including wall outlets, kitchen equipment, furnaces and so forth. The housing enclosure 28 for the alarm device in accordance with this invention is shown mounted interiorly of building 25, typically on an interior wall, with the single wire antenna 29 shown arrayed in an open loop configuration around the building in spaced relation to the perimeter thereof. In a typical installation, the antenna 29 would be placed six to eight feet from the edge of the building and the detector sensitivity has been found to be fully adequate to detect any motion within the entire building. The power distribution from breaker box 26 in FIG. 2 or breaker box 12 in FIG. 1 is energized by 110/220 VAC, 60 hz common house power and the 60 hz voltage is present on all of the distribution lines therefrom. As long as the distribution lines are not shielded cable, the present invention is fully effective. However, even with shielded cable, the invention has been found to be operational if there are unshielded extension wires and the like connected to the outlet within the building.

Figure 3:
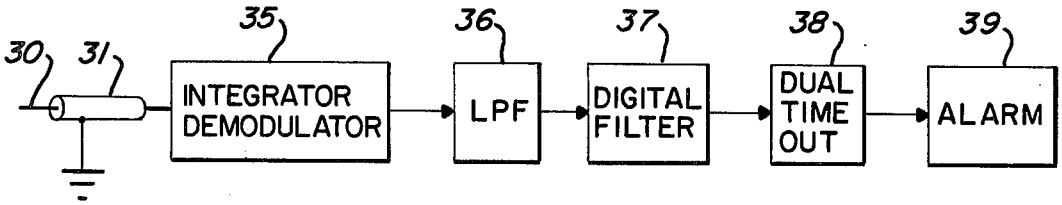
FIG. 3 is a block diagram of the major elements involved in the present invention.

A general block diagram of the present invention is illustrated in FIG. 3 wherein the single wire antenna element 30 is shown being coupled to the input of the circuitry through a section of grounded and shielded cable 31, ground here being earth ground as contrasted to chassis ground as will be more apparent in conjunction with the detailed circuit description. The shielded wire portion 31 extends only from the breaker box to the point of desired initial antenna orientation such as the vertical portion of antenna 22 in FIG. 1. The single wire element 30 then extends for the length of the area to be protected as shown in FIGS. 1 and 2. In a single room surveillance system, the open wire end of antenna 30 typically can be anywhere from six to fifteen feet. The system has been fully operational with the antenna wire 30 of lengths up to five hundred feet.

The existence of conventional unshielded house power or utility power results in the continued presence of a 60 hz field throughout the area associated with the power system. Thus, the dwelling units or the like as shown in FIGS. 1 and 2 are substantially filled with the presence of 60 hz fields whether or not any power is actually being drawn from the input. It has been found that this 60 hz field will be modulated by varying signals in the range of 0 to 20 hz by the motion of an object or person within the area. All of these signals which might be detected by single wire antenna 30 are introduced to one input of integrator/demodulator 35 which employs a reference voltage Vr to produce a time varying summation signal for introduction to a low pass filter 36. Low pass filter 36 will allow signals from 0 to 20 hz to pass through the digital filter 37 where the signals are compared to determine their validity as proper alarm detection signals. Once the digital filter 37 has determined that the signal present is proper for generating an alarm, an output is produced to the dual time-out circuit 38. The dual time-out circuit which can be omitted entirely if desired allows an initial time-out period for the alarm to be deactivated by an authorized intruder and a second time-out to insure that the alarm stays on sufficiently long to attract attention but is subsequently deactivated. Alarm 39 can be an audible bell, visible signal, radio or telecommunication transmitted signal or any of the combinations thereof.

Figure 4:
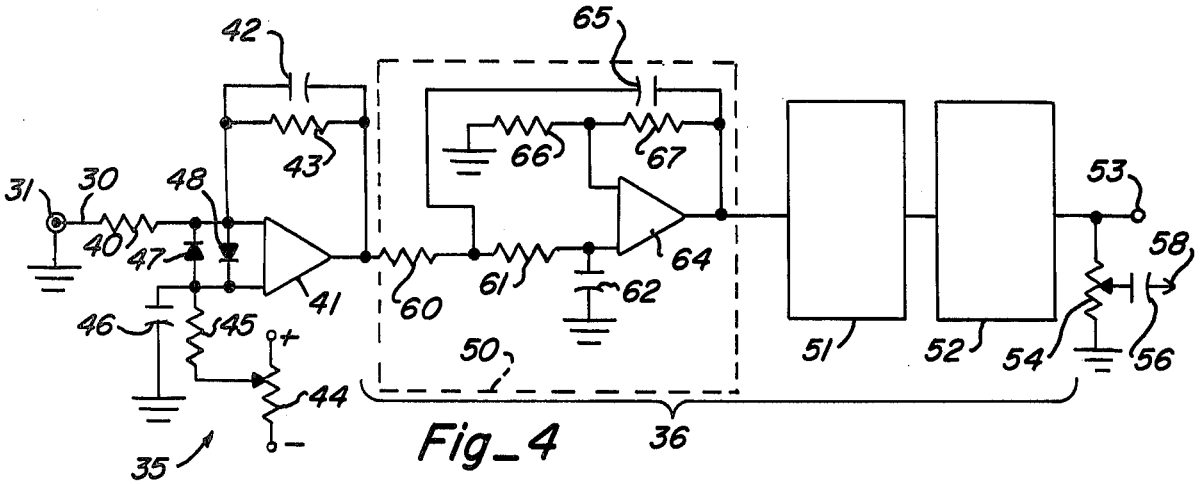
FIG. 4 is a detail circuit diagram of the initial stages of the present invention.

The initial input stages of the system shown in FIG. 3 are illustrated in somewhat greater detail in FIG. 4 and particularly include the integrator/demodulator 35 as well as three identical elements making up the low pass filter 36. The shielded input cable 31 which is typically 75 ohm cable has the center conductor and single wire antenna element 30 connected through an input resistance 40 to the integrator coupled amplifier 41. The output of amplifier 41 is coupled to one input thereof via capacitor 42 and resistor 43. The other input of amplifier 41 is provided by variable resistor 44 which is coupled through resistance 45 to the second input and further coupled in parallel with a capacitor 46 to ground. By employing positive and negative reference voltages to the opposite ends of variable resistance 44, the integrator stage 35 and subsequently DC coupled stages 36 can be initially balanced prior to operation. A pair of oppositely poled diodes 47 and 48 are coupled across the input to provide voltage current limiting.

In a typical operating configuration, coupling resistor 40 is 10 K ohms while resistor 43 is 4.7 megohm and resistor 45 is 51 k. Variable resistor 44 is 0 to 10 K and feedback capacitor 42 is 51 pico farads [pfd] or micromicrofarads. Capacity 42 effectively limits the input frequency coupled to the filter stage 36 with the upper frequency cut-off being a function of the valve of this capacitor. Filter capacitor 46 is typically 0.1 microfarads for coupling purposes. Diodes 47 and 48 are IN914 elements for limiting the voltage excursions to about 0.7 volts whereas amplifier element 41 can be half of an MC 1458 or a 741. This circuit, in addition to producing the time base output associated with the input from antenna 31, likewise provides impedance matching between the antenna and the filter elements and still further reduces the sensitivity of the system to high frequency spikes of 100 hz and above.

The output of integrator demodulator stage 35 is coupled directly to the input of the first stage 50 of the low pass filter 36. Stage 50 is coupled in series with two additional and identical stages 51 and 52 and thus only initial stage 50 will be described in detail. Further, the output of the third stage 52 is coupled to terminal 53 and a variable resistance 54. A coupling capacitor 56 thence introduces the output 58 for subsequent utilization as will be described hereinbelow. The typical filter stage 50 includes a pair of 47 K resistors 60 and 61 which, in combination with a 0.22 microfarad capacitor 62, provides one input to amplifier 64 which is half an MC 1458 or a 741 integrated circuit. A 0.22 microfarad capacitor 65 provides feedback to the resistor network of 60 and 61 while a 39 K resistor 66 and a 56 K resistor 67 provides for a slightly better than unity gain for the amplifier stage. The low pass filter accordingly acts as a combination high gain amplifier and low pass filter to drive a 0 to 1 megohm variable resistance 54. A 1 microfarad coupling capacitor 56 is connected to provide output 58 for use by the digital filter and alarm circuitry. It has been found that the variable resistor 54 can be set to control sensitivity so that, when the single wire antenna is positioned in the ceiling of a typical room, the sensitivity can be controlled so as to detect the presence of moving objects anywhere from 0 to eight feet from the sensing wire or the floor below the sensing wire. Thus, the sensitivity via potentiometer 54 can be set so that the device will not detect the presence of a low moving object such as a watchdog but will produce an output in the presence of a moving person.

Figure 5:
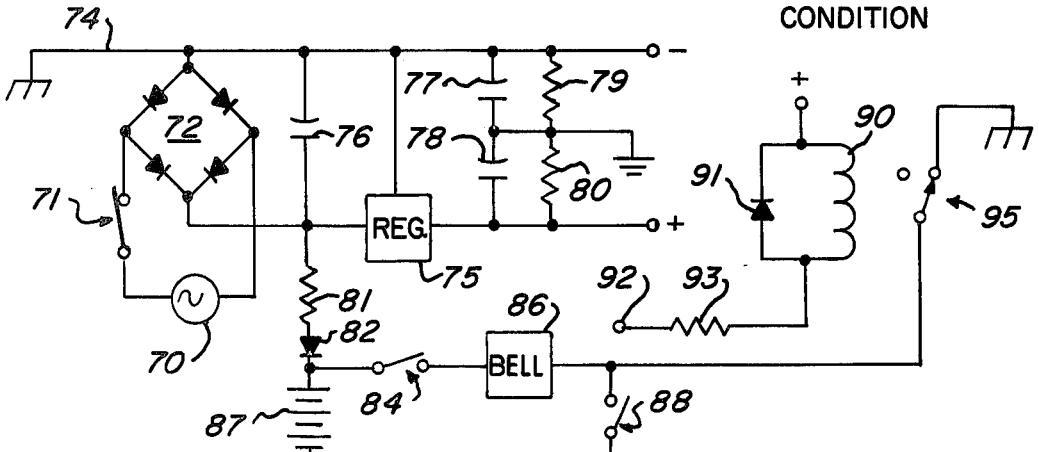
FIG. 5 is a circuit diagram of a power system and bell or alarm actuator circuit.

The power system for the present invention is shown generally in FIG. 5 wherein a 24 volt AC input 70 is connected through an on/off switch 71 into a full wave diode bridge 72 which is composed of four appropriately connected IN4000 type diodes. The negative output line 74 which is connected to chassis ground as shown is likewise to provide the negative input to the appropriate points of the circuitry. The positive output is passed through a 15 volt series regulator 75 after initial filtering by a 100 microfarad capacitor 76. The regulated output is further smoothed by about 50 microfarad capacitors 77 and 78 and resists 1 K resistors 79 and 80. The series regulator 75 is typically an LM340T-15 module. The positive output from the bridge 72 is coupled through 1.3 K resistor 81 and a IN4000 series diode 82 and through a walk test switch 84 to an alarm bell 86 as well as to a standby battery source 87. The "walk test" switch 84 is merely to temporarily deactuate alarm bell 86 so that the user can observe a visible light display discussed subsequently in conjunction with FIG. 6 without audible disturbance.

Switch 88 provides an obvious operational test for bell 86. A relay coil 90 which has a 1N4001 diode 91 in parallel therewith is normally connected to a ground or negative potential at terminal 92 through a 47 ohm resistor 93. Diode 91 prevents the reverse current voltage on coil 90 from destroying the driving semiconductor in stage 160. Thus, the electrical contact 95 is normally maintained in an open condition so that bell 86 is not energized but will close into the position shown to actuate the alarm bell 86 if an intruder is detected by the circuitry or if the main power 70 is lost. Note that to turn the system off completely, those switches 71 and 84 must be opened. That is, opening of only switch 71 which would be the circumstance if main power 70 were lost would effect the result of placing bell 86 across auxiliary power source 87 and generating the alarm.

Figure 6:
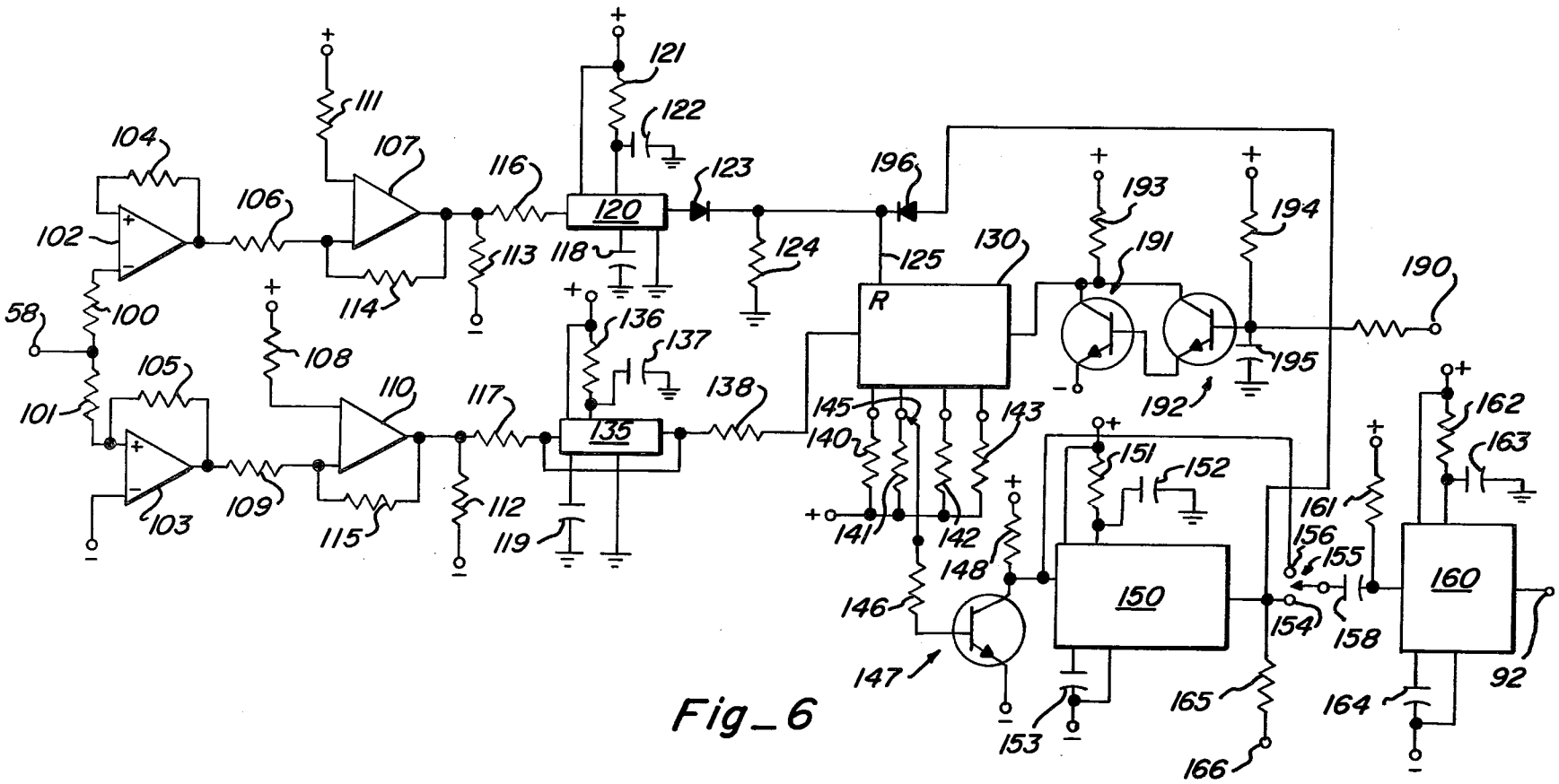
FIG. 6 is a circuit diagram of the elements associated with signal handling of the output of the FIG. 4 circuitry.

FIG. 6 illustrates the details of the digital filter and the time-out circuitry for operating the alarm bell 86 via relay 90 in response to the signals at output 58 of the input stages of FIG. 4. The input 58 is effectively phase split between two signal handling channels starting with two 18 K resistors 100 and 101 to the positive excursion input for amplifier stage 102 and negative excursion amplifier stage 103 each of which has a 1.2 megohm resistor 104 and 105 respectively coupled thereacross. The output of amplifier 102 is coupled through a 100 K resistance 106 as shown to provide one input to a Schmitt trigger coupled amplifier 107. The other input for amplifier or Schmitt trigger coupled stage 107 is a 510 K resistor 111 whereas the negative coupling for the Schmitt trigger coupled amplifier stage 110 is through a 1 K resistor 112. The output of amplifer stage 107 is likewise coupled through a 1 K resistor 113 to the negative power source. Both amplifier stages have the output thereof fed back through 1 megohm resistors 114 and 115 respectively. A 510 K resistor 108 to provide one input for bias current level into Schmitt tritter stage 110, the other input of which is through a 100 K coupling resistor 109. Note that Schmitt trigger stage 107 and 110 are effectively identical. Typically, amplifiers 102, 103, 107 and 110 are all four present on an LM3900 current amplifier integrated circuit module.

The positive trigger transitions of the Schmitt circuit are coupled through a 10 K resistor 116 while the negative transitions are coupled likewise through a 10 K resistor 117. The positive excursions are connected to a retriggerable single-shot circuit 120 which is coupled to the positive power source through a 150 K resistor 121 and a 15 microfarad capacitor 122 relative to ground. The single shot 120 is typically a half section of an SIL4098BE integrated circuit unit and the output is coupled through a IN914 type diode 123 and a 1 K resistor 124 into the reset input 125 of an SIL4017BE counter integrated circuit module 130. Thus, with the circuit quiescent so that no signals are being detected at inputs 58 and the retriggerable single-shot 120 being off, counter 130 is prevented from storing counts.

Single shot 120 enables the counter 130 by removing the reset input 125 upon initiation by a positive transition at input 58. This enabling continues for a preselected time period based upon the RC time constant of elements 121 and 122 are re-initiated each time there is a zero-crossing excursion at 58 in an appropriate direction which allows the counter 130 to be incremented by the non-retriggerable single shot 135. Single shot 135 is coupled to the positive power source by 470 K resistor 136 and 3.5 microfarad capacitor 137. Further, single shot 135 is implemented as the other half of an SIL4098BE integrated circuit element. The output of single shot 135 is coupled through a 1 K resistor 138 to the incrementing input of counter 130 which is typically an SIL4017BE integrated circuit. The contents of counter 130 are reflected by the output terminals to which are coupled a plurality of 10 K resistors 140–143. The particular count to be selected for enabling the alarm is chosen by a switch or jumper arrangement 145 which is coupled through a 1.5 K resistor 146 into a 2N2907 or equivalent transistor 147. Transistor 147 is coupled to the power source through a 10 K collector resistor 148 and provides an input to timer delay circuit 150 which is typically half of a 556 integrated circuit. Timer delay 150 is coupled to the power source through a 220 K resistor 151 and a 47 microfarad capacitor 152 while being coupled to the negative power source through a 0.01 microfarad capacitor 153.

The output of timer delay circuit 150 is connected to terminal 154 of switch 155 and will produce an output pulse for a fixed time period thereafter. The purpose of timer delay 150 is to allow a predetermined time to elapse prior to full enabling of the alarm so that an authorized user can enter the building and have an opportunity to deactivate the alarm system as by key operation of the off switch to remove power therefrom. With the elements as set forth hereinbefore, the time delay is approximately 15 seconds. In the event that no time delay is intended, switch 155 would be set so that contact with terminal 156 is established and thus the acquisition of an appropriately selected count level from counter 130 will immediately energize the alarm.

In any event, the output of switch 155 is coupled through a 100 pfd capacitor 158 into a second time delay circuit 160 which is formed from the second half of the 556 integrated circuit module. This module is coupled to the positive power source through a 51 K resistor 161 and also through a 1.1 megohm resistor 162 and a 100 microfarad capacitor 163. Coupling to the negative power source is through a 0.01 microfarad capacitor 164. By this circuit configuration, delay circuit 160 normally produces an enabling signal at output terminal 92 which is coupled to the commonly numbered terminal in FIG. 5 so as to actuate relay 90 and open bell contact 95. As soon as a signal is received from switch 155 by delay 160, the enabling output at terminal 92 is dropped thereby closing switch 95 and causing the alarm to be sounded for a two to three minute time period. Both timer delay 150 and 160 are RC voltage independent circuits.

The output of delay 150 is likewise coupled through a 1K resistor 165 to an output terminal 166 connected to an LED display device. Thus the user is allowed to determine the operability of the intrusion detector by opening switch 84 of FIG. 5 so as to disable bell 86 but with the other elements of the circuitry being fully operational. Accordingly, the user can power the circuit and open switch 84, step into the area wherein intrusion detection is intended and visually observe the display lamp associated with terminal 166 to insure that it comes on after the fifteen second delay.

Figure 7A:
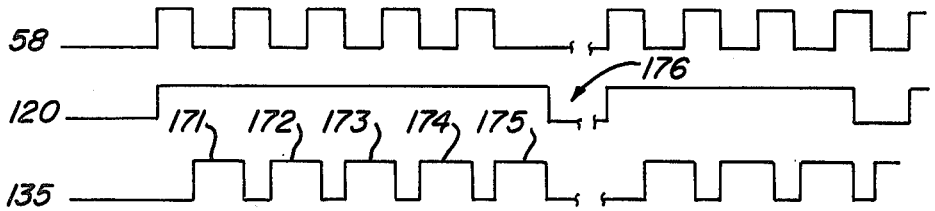
FIG. 7 is a time base diagram of the operating interrelationships for some of the elements in FIG. 6.
Figure 7B:
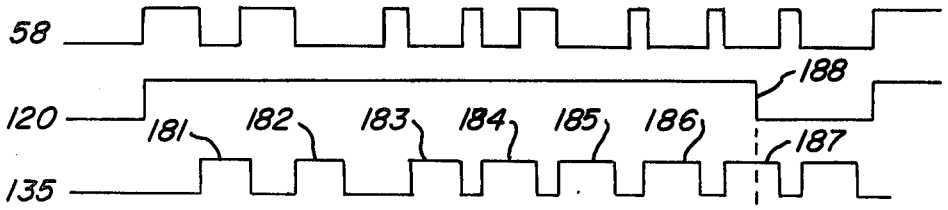

FIGS. 7A and 7B illustrate two typical operating examples associated with the timing windows or gates effected by the single shot circuit 120 and 135 of FIG. 6. More particularly, FIG. 7A depicts an idealized time-base operation of the system in response to a regularly recurring interference signal such as a telephone ringing, refrigerator motor running or the like. Under these circumstances, the output of the integrator/demodulator and low pass filters is a generally regularly recurring wave pattern as shown for input 58 in FIG. 7A. The initial pulse causes the retriggerable single shot 120 to begin its time tolling as shown. Because of the regularly recurring input 58, the non-retriggerable single shot 135 will only occasionally drop as shown before single shot 120 generates reset pulse 176. Thus, only five potentially countable increment pulses 171–175 will occur prior to the reset pulse 176 of the retriggerable single shot 120. Assuming that output switch 145 of FIG. 6 is set to produce an out-put only after a minimum of seven counts has been loaded into counter 130, the alarm generating signal will never be produced since reset pulse 176 will clear counter 130 prior to reaching that level.

Conversely, FIG. 7B illustrates the circuit operation in the presence of the randomly frequency varying signals produced by the presence of an intruder wherein no continuous wave pattern is actually generated. The non-retriggerable single shot 135 is set at a time base of approximately one second so that 20 hz continuous signals or the like will continually retrigger 120 as illustrated in FIG. 7A and only cause minimal retriggering of 135. However, this circumstance does not exist with random signals as shown in FIG. 7B, since, if the non-retriggerable single shot 135 sees a time period greater than a fourth of the twenty cycle ring, it will periodically fall out as shown in FIG. 7B. That is, with the random pattern at input 58 as shown in FIG. 7B, a sequence of seven countable pulses 181–187 will occur prior to the reset signal 188 from the retriggerable single shot 120. In fact, generation of the alarm condition shown on FIG. 7B causes automatic reset of counter 130 regardless of the state of 58 of 120. Again assuming that output switch 125 for counter 130 has been set to produce an output in the presence of seven incrementing pulses to counter 130, the occurance of pulse 187 will cause the generation of an alarm despite the presence of reset signal 188.

In a typical implementation, a two-pole, four-position lock switch such as the model 3000 produced by ADEMCO or equivalent is employed for the purpose of implementing the control switch function. Typically this switch would be mounted on a panel either on the front of the enclosure or within the locked cover of such an enclosure for the entire circuitry such as enclosures 20 and 28 shown in FIGS. 1 and 2. One of the switch positions if the full "off" position where, with reference to FIG. 5, switches 71 and 84 are both open to fully disable the entire system. In a second position of the four-position switch, the system is powered via closure of switch 71 but opening of switch 84 to allow the aforementioned walk test wherein the user can visually observe the lamp at output 166 to determine operation of the system. In a third position of this four-position switch, power switch 71 and bell switch 84 are both closed as is switch 88 thereby allowing the user to select testing of the bell to determine its operation. Finally, the fourth position is the full "on" condition wherein switches 71 and 84 are closed and switch 88 opened as shown in FIG. 5 and the system is fully enabled. It should be noted that an additional time delay could be incorporated for delayed closing of full on power switch 71 if desired so as to allow the user adequate time to leave the protected environment prior to actuation of the system.

Reviewing, the retriggerable single shot 120 is set for some predetermined time period such as approximately two seconds and the counter 130 has the output thereof coupled for sensing some preselected digital time delay to block receipt of unintended signals. The non-retriggerable single shot 135 is set to produce a pulse with 20 to 40 hz width and is re-enabled by each approproately timed transition at the input thereof. As is well known, counter circuits such as 130 can be employed so as to select any of the particular counter content stages. Thus, since the integrator/demodulator and low pass filter produce a signal reflective of the presence of modulation signals up to about 20 hz, the output of the low pass filter elements could be used as a direct alarm indication but this output is sensitive to inaccurate intrusion indicating transient signals such as telephone ringing, refrigerator motor operations, line spikes and the like. Therefore, the retriggerable and non-retriggerable single shots and counter circuits act as a digital filter of the output to inspect this output and produce an alarm signal only under appropriate circumstances as discussed in detail above.

In use, the housing containing the circuitry of the present invention is installed in some secured location within or without the area to be protected. The area to be protected is inspected and, assuming that typical unshielded primary power wiring is present so that the 60 hz field is continually present within that area, the antenna can then be installed by extending the shielded portion to the proximity with the area to be protected and the unshielded single wire antenna arrayed in an appropriate configuration. The antenna can be looped over itself, coupled with branch extensions, passed through shielding conduit to monitor physically spaced areas, or the like. The antenna can be placed in an overhead area, under rugs, along walls or in any desirable location and its orientation relative to the sources of the 60 hz field is immaterial. In the event that it is determined that the area to be protected has only shielded and grounded wiring, the presence of the field can be produced by merely stringing an extension cord, lamp cord, or the like from an outlet. Generally, the system will be balanced via adjustment of variable resistor 44 [note FIG. 4] and the user selects the particular sensitivity desired by adjustment of variable resistor 54. Thus, the single wire antenna can be placed within the overhead area and variable resistor 54 selected so that any movement within a zone above or coextensive with the floor of the protected area is involved.

Further, the particular digital time period to be selected via setting of switch 145 in FIG. 6 will generally be factory set but can be modified by the user if desired in the event that it is determined that the time period is inadequate to present false signals. The user can likewise select whether a time delay for bell actuation via setting of switch 155 is to be employed to allow the user to disable the alarm on re-entry to the protected area.

As mentioned, the user can test the operation of the system via the lamp display and the operability of the alarm via appropriate switch settings. In any event, the system is actuated either immediately [assuming the user has no objection to leaving the protected area with the alarm bell operating if the housing is within the protected area] or after an appropriate time delay of power application. The presence of an intruder within the sensitivity zone of the system in the protected area will result in random modulations of the 60 hz field and thus produce an appropriate output from the integrator/demodulator and low pass filter for incrementing of the counter circuit and initiation of the alarm bell. This alarm bell can provide a local signal, can be transmitted to a remote location, or any of various potential combinations of alarm generations. For instance, the separate output to a remote location at terminal 190 shown in FIG. 6 can be provided if desired via transistor driver 191 and 192. These transistors are coupled to the power source via 10 K resistor 193 and a 3.9 megohm resistor 194, respectively, with the output being coupled to the negative power source by 100 microfarad capacitor 195. Note that the presence of alarm signals as the output of time delay 150 is returned through diode 196 to reset the counter 130 since the initiation of the alarm signal is irretrievable once the appropriate count of 130 has been reached.

Although the present invention has been described with particularity relative to the foregoing exemplary preferred embodiment, various modifications, changes, additions and applications thereof other than those specifically mentioned herein will be readily apparent to those having normal skill in the art without departing from the spirit of this invention.

What is claimed is:

1. Apparatus for reliably sensing the presence of a range of modulation signals imposed upon ambient electromagnetic waves within an area requiring surveillance wherein the modulation signals result from movement of an intruder within the area comprising:

antenna means for generating an output in response to the presence of said ambient electromagnetic waves including modulation thereof within the surveillance area, means responsive to the output of said antenna means for demodulating and producing an output therefrom, filter means responsive to said demodulation means output for passing to an output of said filter means signals including only demodulated signals within the intruder originated range, differentiating means responsive to said filter means output for generating an output reflecting the presence of signals originating from randum modulation of the ambient electromagnetic waves, and means responsive to said differentiating means output for establishing an alarm.

2. Apparatus in accordance with claim 1 wherein said demodulation means includes an integrator circuit for producing output signals corresponding to bidirectional excursions of low frequency signals at the output of said antenna means.

3. Apparatus in accordance with claim 1 wherein said filter means passes to said output thereof only said demodulation means output within the range of zero to about twenty cycles per second.

4. Apparatus in accordance with claim 1 wherein said differentiating means includes a first pulse generator circuit responsive to signals from said demodulation means output for generating a pulse of a preselected duration, a second pulse generator circuit for generating pulses corresponding in recurrence to varying frequency signals of said demodulation means output, and counter circuit means enabled during presence of said first pulse generator circuit pulse for storing counts corresponding to said second pulse generator circuit pulses.

5. Apparatus in accordance with claim 4 wherein said alarm establishing means is enabled by the presence of a preselected count within said counter circuit means, said counter circuit means being reset upon termination of each said first pulse generator circuit preselected duration pulses.

6. Apparatus in accordance with claim 1 wherein there is included circuit means for delaying the coupling of said differentiating means output to said alarm establishing means for allowing an authorized intruder sufficient time to disable said alarm establishing means.

7. Apparatus in accordance with claim 1 which includes a visible display coupled to said differentiating means output, and means for temporarily disabling said alarm establishing means whereby the user can determine proper operation of said apparatus without production of a false alarm.

8. Apparatus in accordance with claim 1 which further includes means for adjusting the level of signals coupled to said differentiating means from said filter means thereby permitting preselection of the distance from said antenna means that modulated electromagnetic waves will be detected.

9. Apparatus in accordance with claim 1 which includes primary and secondary power sources with said primary source being coupled for normally energizing said alarm establishing means, and sensor means responsive to loss of power from said primary power source for actuating said alarm establishing means by said secondary power source.

10. Apparatus for indicating the presence of a moving intruder within an area permeated by ambient electromagnetic waves as from power utility wiring associated with the area comprising:

a single wire antenna located in the area for generating an output in response to detecting the presence of said ambient electromagnetic waves therein including modulation thereof by the moving intruder, a limiting circuit responsive to the antenna output for producing a limiting signal output including signals corresponding to the modulation of the ambient electromagnetic waves in the area, a low pass filter responsive to said limiting signal output for passing only signals of approximately twenty cycles per second or less, first and second signal handling channels responsive to signals passed by said low pass filter for generating respective output pulses, said first channel output pulses being produced in a quantity correlated to variable frequency signals of said low pass filter and in a lesser quantity in the presence of relatively constant frequency signals of said low pass filter, a counter circuit enabled for the duration of each said second channel output pulse for storing counts corresponding to said first channel output pulses with the counts stored in said counter circuit being cleared at the termination of each said second channel output pulse, said second channel output pulses having a duration adequate for allowing said first channel output pulses to occur in a greater quantity in correlation of said variable frequency signals than in correlation to said relatively constant frequency signals, an alarm, and means responsive to the counts stored in said counter circuit greater than said relatively constant frequency quantity but not greater than said variable frequency quantity for enabling said alarm.

11. Apparatus in accordance with claim 10 wherein said limiting circuit includes an integrator circuit connected to said antenna for producing time correlated output signals in response to signals from said antenna for no greater than one hundred cycles per second.

12. Apparatus in accordance with claim 10 wherein said low pass filter includes a plurality of serially connected stages each having a gain greater than unity and reactive feedback for limiting the maximum frequency response.

13. Apparatus in accordance with claim 10 which includes means for adjusting the magnitude of the signals passed by said low pass filter output so as to control the distance sensitivity relative to the spacing between said antenna and a moving intruder.

14. Apparatus in accordance with claim 10 wherein said channels each includes a serially interconnected combination of a current amplifier, a pulse squaring circuit and a single shot pulse generator.

15. Apparatus in accordance with claim 10 wherein said alarm enabling means includes a delay circuit for withholding said alarm enabling for a time period adequate to permit an authorized intruder to disable said alarm.

16. Apparatus in accordance with claim 10 wherein said alarm enabling means includes a timing circuit for enabling said alarm for a preselected time period subsequent to occurrence of said first channel output pulses.

17. Apparatus in accordance with claim 10 which includes primary and auxiliary power sources with said primary source being normally connected for energizing said alarm only in response to said enabling means, and means responsive to loss of power from said primary source for energizing said alarm from said auxiliary power source.

18. Apparatus in accordance with claim 10 which further includes a visible display connected for actuation by said enabling means.

19. Apparatus in accordance with claim 18 which includes means for temporarily disabling said alarm for allowing verification of proper occurrence of signals for enabling said alarm.

* * * * *